US010905622B2

(12) United States Patent
Patel

(10) Patent No.: US 10,905,622 B2
(45) Date of Patent: Feb. 2, 2021

(54) PORTABLE DEVICE FOR MASSAGE

(71) Applicant: UMA Innovative Manufacturing Company, Ahmedabad (IN)

(72) Inventor: Baldevbhai Ramanlal Patel, Ahmedabad (IN)

(73) Assignee: UMA Innovative Manufacturing Company, Gujarat (IN)

( * ) Notice: Subject to any disclaimer, the term of this patent is extended or adjusted under 35 U.S.C. 154(b) by 198 days.

(21) Appl. No.: 16/085,897

(22) PCT Filed: Mar. 3, 2017

(86) PCT No.: PCT/IN2017/050079
§ 371 (c)(1),
(2) Date: Sep. 17, 2018

(87) PCT Pub. No.: WO2017/158618
PCT Pub. Date: Sep. 21, 2017

(65) Prior Publication Data

US 2019/0091096 A1 Mar. 28, 2019

(30) Foreign Application Priority Data

Mar. 18, 2016 (IN) ..... 201621009606

(51) Int. Cl.
*A61H 7/00* (2006.01)
*A61H 23/02* (2006.01)

(52) U.S. Cl.
CPC ..... *A61H 7/005* (2013.01); *A61H 23/02* (2013.01); *A61H 2201/1215* (2013.01);
(Continued)

(58) Field of Classification Search
CPC .. A61H 7/005; A61H 7/006; A61H 2007/009; A61H 9/0007; A61H 15/0085; A61H 15/02; A61H 23/006; A61H 23/0254; A61H 2015/0028; A61H 2201/1215; A61H 2201/1463; A61H 2201/1472; A61H 2201/149; A61H 2201/1678;
(Continued)

(56) References Cited

U.S. PATENT DOCUMENTS 3,906,940 A * 9/1975 Kawada ..... A41D 23/00 2/207
4,149,530 A 4/1979 Gow
(Continued)

FOREIGN PATENT DOCUMENTS

| | | |
|---|---|---|
| CN | 203677490 | 7/2014 |
| CN | 104434484 | 3/2015 |
| WO | 20030082179 | 10/2003 |

*Primary Examiner* — Tu A Vo
*Assistant Examiner* — Alexander Morales
(74) *Attorney, Agent, or Firm* — Occhiuti & Rohlicek LLP

(57) ABSTRACT

A portable device for massage provides both massage through vibration and oil rubbing. The device mainly includes a gear mounting plate along with shafts, motor, motor gear, cycle gear, first bevel gear, bracket along with actuator and quarter pin joint, second bevel gear, vibrating plate along with vibrating knobs, oil rubbing plate, crank pin and bearing. This device is operated on DC current which makes it suitable for usage in vehicles. This device provides relief through vibration and oil rubbing at any part of body based on inception of pain.

5 Claims, 6 Drawing Sheets

(52) U.S. Cl.
CPC ..... *A61H 2201/149* (2013.01); *A61H 2201/1463* (2013.01); *A61H 2201/1695* (2013.01); *A61H 2201/5035* (2013.01)

(58) Field of Classification Search
CPC .... A61H 2201/1695; A61H 2201/5035; A61H 2201/1666; A61H 2201/1664; A61H 2201/1669; A61H 2201/1671; A61H 2201/1673; A61H 7/00; A61H 7/001; A61H 7/002; A61H 7/003; A61H 7/004; A61H 7/007; A61H 15/00; A61H 15/0078; A61H 2015/0007; A61H 2015/0014; A61H 2015/0021; A61H 2015/0035; A61H 2015/0042; A61H 2015/005; A61H 2015/0057; A61H 2015/0064; A61H 2015/0071
USPC ..... 601/46, 67, 69, 70, 72, 73
See application file for complete search history.

(56) References Cited

U.S. PATENT DOCUMENTS

| | | | | |
|---|---|---|---|---|
| 6,537,235 | B1 * | 3/2003 | Connor | A41D 23/00 2/207 |
| 6,579,251 | B1 * | 6/2003 | Randoll | A61H 23/0254 601/89 |
| 6,902,525 | B1 * | 6/2005 | Jewell | A61H 19/44 600/38 |
| 2003/0028134 | A1 * | 2/2003 | Lev | A61H 7/001 601/110 |
| 2003/0199796 | A1 | 10/2003 | Yamazaki et al. | |
| 2004/0064074 | A1 * | 4/2004 | Kennedy | A61H 23/04 601/55 |
| 2015/0132041 | A1 * | 5/2015 | Muraki | B01F 7/00891 401/4 |
| 2015/0189980 | A1 * | 7/2015 | Hwang | A46B 13/008 15/28 |
| 2016/0045081 | A1 * | 2/2016 | Kern | A46D 1/0238 15/22.4 |

* cited by examiner

PORTABLE DEVICE FOR MASSAGE

CROSS-REFERENCE TO RELATED APPLICATIONS

This application is the National Stage under 35 USC 371 of International Application No. PCT/IN2017/050079 filed on Mar. 3, 2017, which claims the priority of Indian Application No. 201621009606, filed on Mar. 18, 2016. The contents of both applications are hereby incorporated by reference in their entirety.

FIELD OF THE INVENTION

The present invention is related to a portable device for massage comprises dual means of vibration and oil rubbing treatment to any part of the body, more particularly it provides DC current operated device for massage treatment in vehicles through pair of oscillating vibration knobs and rubbing plate.

BACKGROUND OF THE INVENTION

Nowadays, most of journeys are through cars, buses, aero-planes and trucks with various purposes like, for to and from work, for driving vehicles as a part of job i.e. for truck drivers, bus drivers, taxi drivers, for pleasure or for vacation tour. Driving and traveling exposes the body to many different forces including acceleration, deceleration and vibration of whole body which leads to report body pain and ache in different individuals. Large heavy goods vehicle like truck, drivers are exposed to a lot of vibration and consequently this group of people are more susceptible towards the health issues.

Approximately 30-60% of drivers suffer from minor problems such as lower back pain, foot cramp, frozen shoulder, stiff neck, finger cramp and arm pain to major problems such as cervical spondylitis, carpel tunnel syndrome and many other musculoskeletal disorders.

There are different reasons for such a body pain like, sitting for prolonged period in awkward position, whole body vibrations from the vehicle traveling on uneven or bumpy road surfaces, vehicle seat design, etc.

Presently various remedies are available for this problem which mainly includes pain killers, regular massage therapy, physiotherapy etc. These remedies have their own limitations which mainly includes expensive treatment, side effects, time consuming process etc.

In current state of art, many devices have been developed for massage as indicated by:

U.S. Pat. No. 4,149,530 describes a hand held, portable, rechargeable electric vibrator which includes a handle portion and a spherical vibrating portion with eccentrics which rotates so as to impart a vibratory motion to the spherical portion of the device.

CN104434484 describes back massager having massage shaft automatically scroll back and forth to massage the user while able to make a liquid outlet through vibration massage column automatically opening and closing cycle, ultimately automatic massage oil is applied to the user and US 2003/0199796 describe portable massaging device having pair of massaging balls used for massaging a specific portion of human body.

All of the above prior art have various limitation such as not useful for all body parts, operated on battery, works on AC current, providing either vibration or oil massager, bulky, difficult to carry outside, expensive, etc.

In conclusion none of the prior art provides device for relieving body pain in long distance traveling in car or trucks which works on DC.

SUMMARY OF THE INVENTION

The present invention provides a portable device for massage (20). The present invention discloses dual means for massage through vibration and oil rubbing. The device mainly comprises a gear mounting plate (3) along with shafts (4-5), motor (1), motor gear (7), cycle gear (6), first bevel gear (15), bracket (8) along with actuator (9) and quarter pin joint (18), second bevel gear (16), vibrating plate (13) along with vibrating knobs (12), oil rubbing plate (14), crank pin (11) and bearing (10). This device (20) is operated on DC current which makes it suitable for usage in vehicles. This device (20) provides relief through vibration and oil rubbing at any part of body based on inception of pain. This device (20) provides advantages like portable, self operated, versatile, dual means for massage (i.e. vibration and rubbing), economical, durable and light weight etc.

OBJECTIVE OF THE INVENTION

The main objective of the present invention is to provide portable, self-efficient and easy to use device for relieving pain of different body parts.

The further objective of the present invention is to provide massager which can be operated on DC current i.e. through mobile charging socket in vehicles during traveling.

The other objective of the present invention is to provide a device containing vibrator and oil massager for relieving body pain.

The another object of the present invention is to provide a device for reliving body pain in easy, simple yet effective and economical manner.

DETAILED DESCRIPTION OF THE INVENTION

Before explaining the present invention in detail, it is to be understood that the invention is not limited in its application to the details of the construction and arrangement of parts illustrated in the accompany drawings. The invention is capable of other embodiments, as depicted in figure as described above and of being practiced or carried out in a variety of ways. It is to be understood that the phraseology and terminology employed herein is for the purpose of description and not of limitation.

Figure 1:
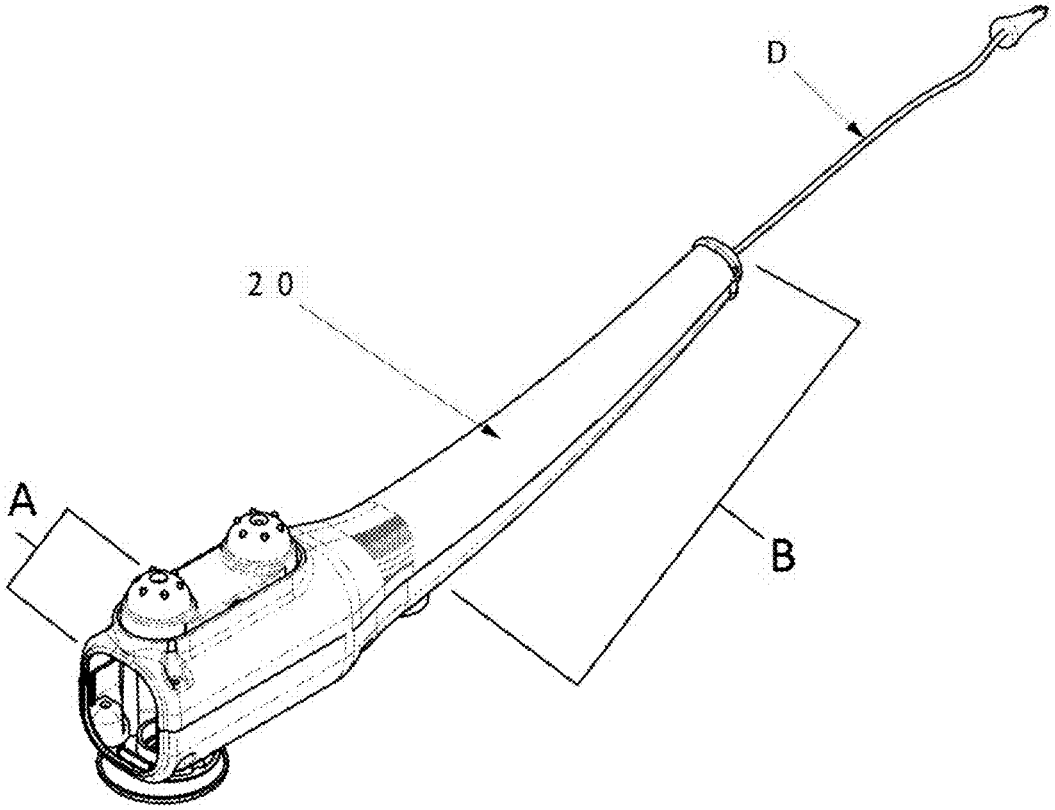
FIG. 1 shows slant view of device showing vibrating knobs
Figure 2:
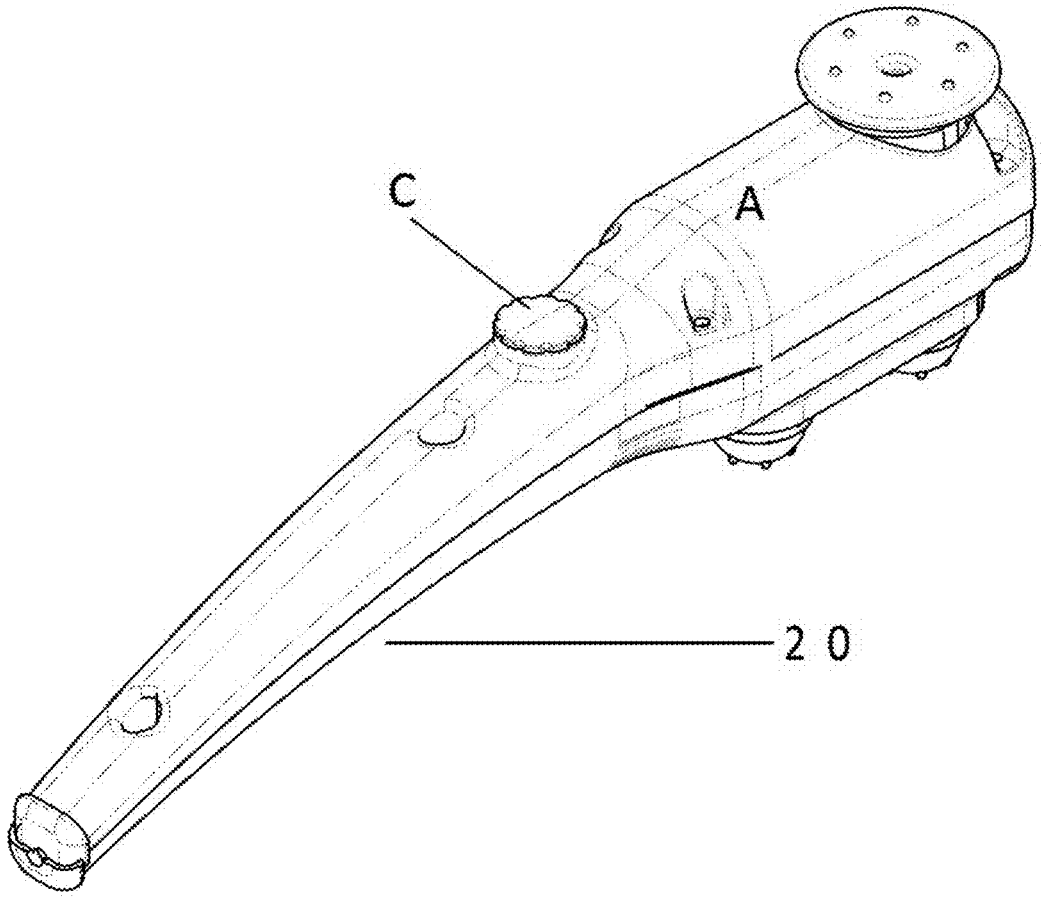
FIG. 2 shows slant view of device showing rubbing plate

FIG. 1 and FIG. 2 describe perspective views of the device (20) for hammering massage and oil rubbing massage respectively. The device (20) has head (A) for massage on body, handle (B) to hold the device (20) by the user's hand.

The device (20) has two different embodiments to massage the body which is used by flipping the device by user.

As shown in FIG. 1, device (20) provides vibration means through vibrating knobs (12). The vibrating knobs (12) are applied to the affected area by user to get relief from the body ache. The handle (B) has opening for a cord (D) for DC power supply. The cord (D) connects the device (20) with power connector. The length of the cord (D) is such that it is used by driver and also by the other persons sitting in the car.

As shown in FIG. 2, in the present device (20), massage is done through the oil rubbing plate (14). Further, device (20) has a rotary switch (C) as the adjustable means to adjust intensity of the massage as per user's requirement.

Figure 3:
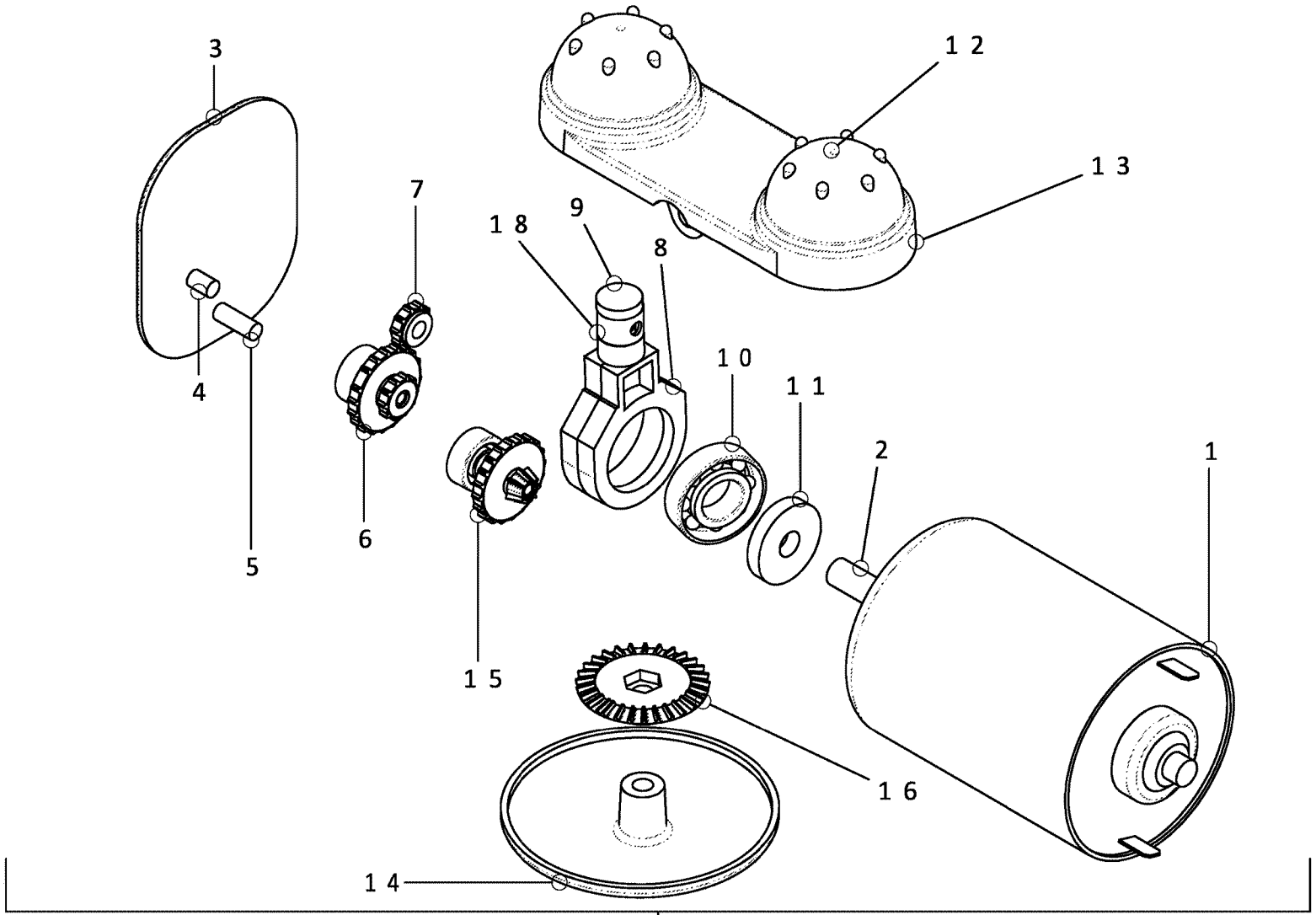
FIG. 3 shows perspective exploded view of the present invention

FIG. 3 describes exploded view of internal components of the head (A) of the present device (20). The device (20) has a gear mounting plate (3), at distal end of a motor shaft (2), which has a pair of shaft (4, 5). The shafts (4, 5) are coaxial with each other and positioned upwardly with respect to the gear mounting plate (3). The lower shaft (5) is long compared to the upper shaft (4). Cycle gear (6) is mounted on the upper shaft (4) and the first bevel gear (15) is mounted on the lower shaft (5). The cycle gear (6) has toothed ring around central hole to rotate concurrently with the first bevel gear (15). The cycle gear (6) is positioned with a motor gear (7) to rotate concurrently with each other. The motor gear (7) accommodates in the motor shaft (2). Bracket (8) has a hollow structure in central region with space to accommodate a bearing (10) and a crank pin (11). The bearing (10) and the crank pin (11) are mounted on proximate end of the motor shaft (2) of a DC motor (1) that provides support and vibration free movement to the motor gear (7). The actuator (9) is situated on the top of bracket (8). The quarter pin joint (18) is sandwiched between the bracket (8) and a vibrating plate (13) to offer up and down movement to the vibrating plate (13). The vibrating plate (13) is positioned on upper side of a case (17) (Shown in FIG. 4) which covers the motor (1). The vibrating plate (13) has a pair of vibrating knobs (12) which are at least two hemispherical protuberances which are responsible for oscillating knobs (12) like a pendulum to provide hammering massage to the body. One of the vibrating knob (12) is movably connected with the actuator (9). The second bevel gear (16) is positioned perpendicular to the lower side of the first bevel gear (15) to rotate concurrently with each other. The second bevel gear (16) has upper surface to contact with the first bevel gear (15) and lower surface to be attached with the rubbing plate (14). The oil rubbing plate (14) is positioned to the lower part of case (17) which covers the motor (1) (shown in FIG. 4). The motor (1) is connected at distal end to PCB which is placed in handle (B) of the device (20).

Figure 4:
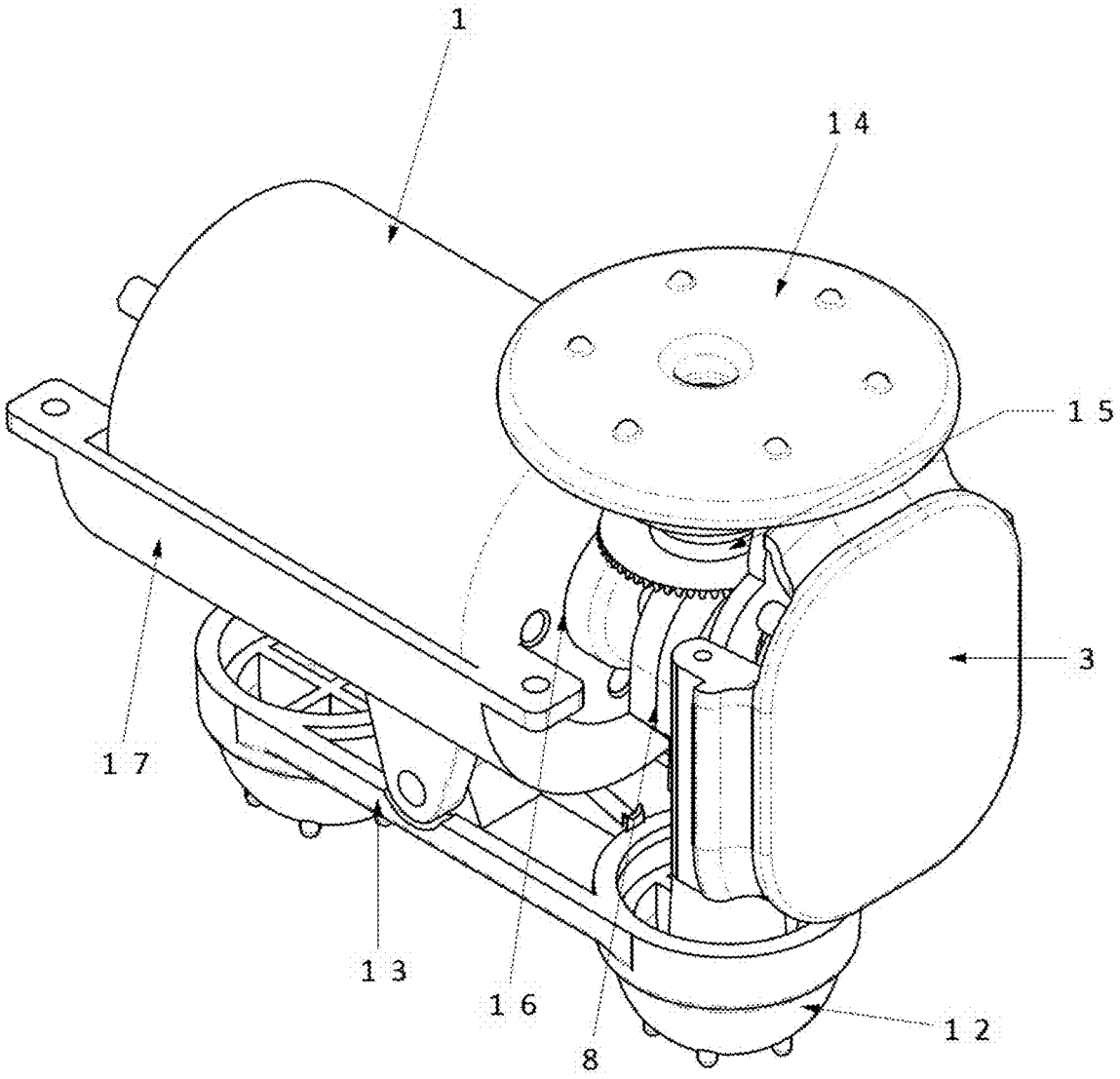
FIG. 4 shows perspective view of assembled components of the present invention

FIG. 4 describes assembled components in the device where various components described in FIG. 3 are assembled with each other to form the device (20). The present figure provides perspective view of device (20) for oil rubbing massage. The DC motor (1) is surrounded by the case (17) which has a means for attaching the vibrating plate (13). The gear mounting plate (3) along with the gear system is fixed at proximate end of the device (20). Once the components are positioned in horizontal axis as described above then vertical axis components are attached by mounting the vibrating plate (13) on upper side of the case (17) and the detachable oil rubbing plate (14) which is placed on the lower side of the case (17) is rotatably attached with the second bevel gear (16). The vibrating knob (12), motor (1) and oil rubbing plate (14) are interconnected through gear system. The rubbing plate (14) is circular having protuberance on top and detachable means at the bottom of the plate (14).

Figure 5:
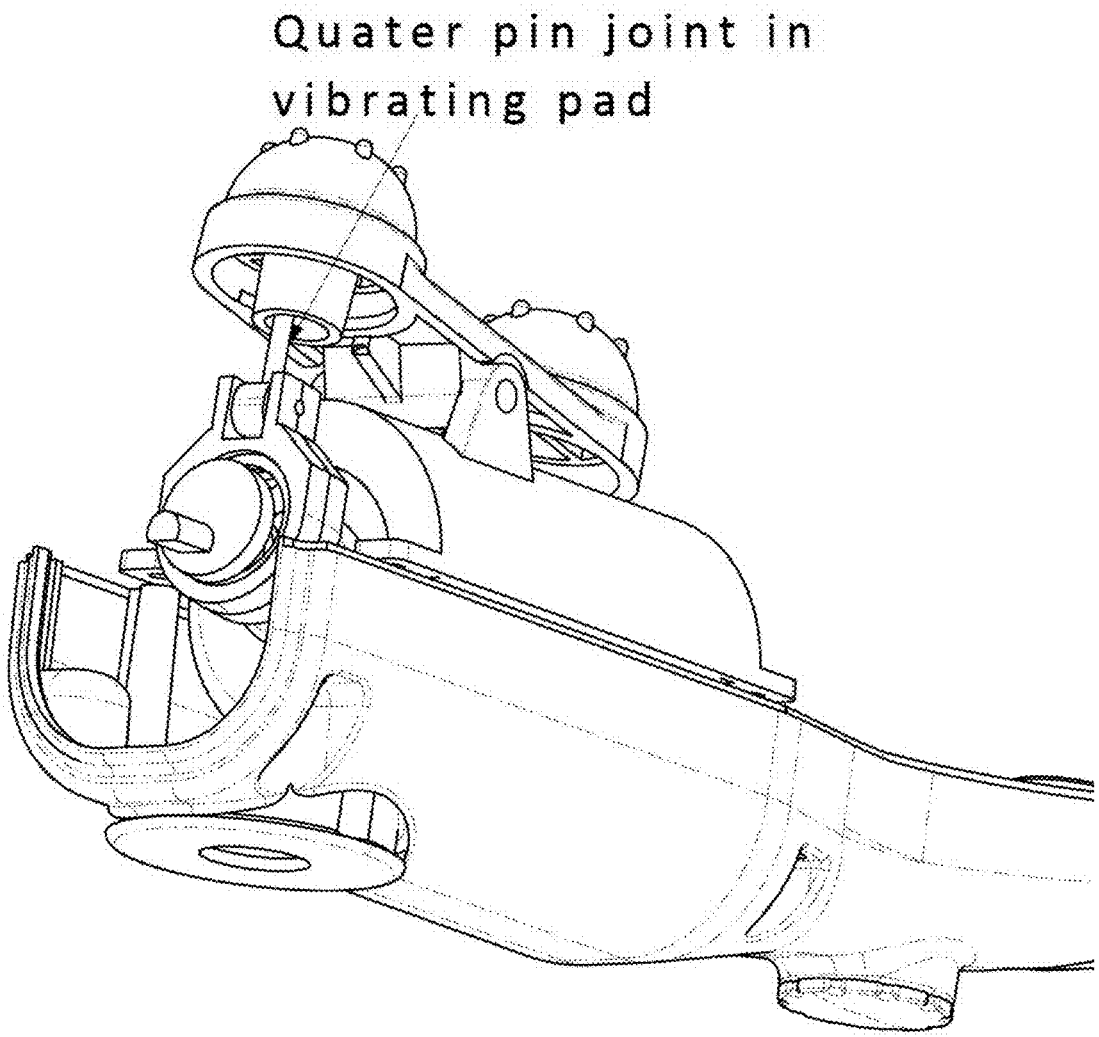
FIG. 5 shows quarter pin joint for vibrating pad in the present device.

FIG. 5 shows quarter pin joint (18) which is sandwiched between the bracket (8) and the vibrating plate (13), which moves in up and down direction for providing hammering motion to the vibrating knobs (12).

Figure 6:
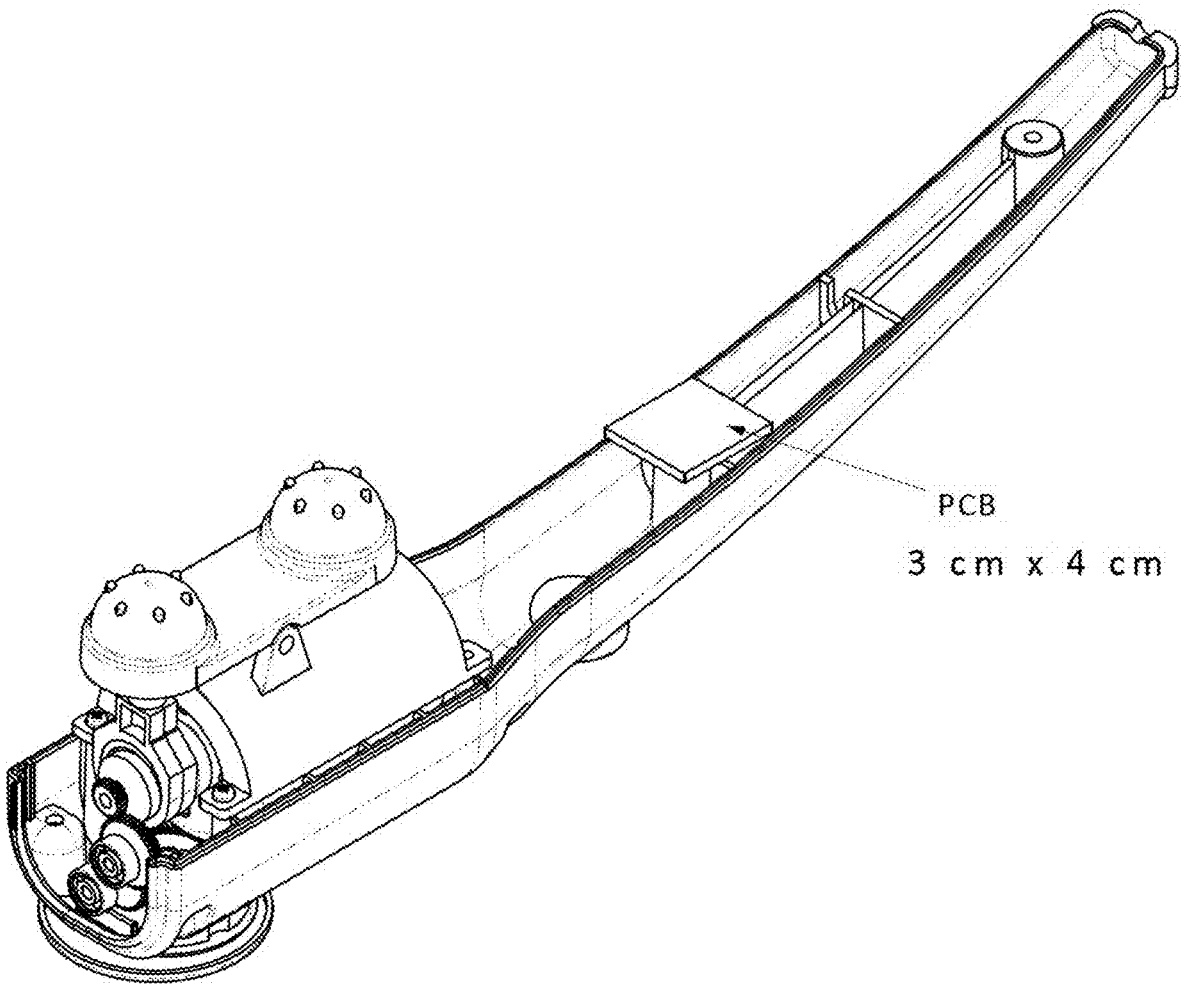
FIG. 6 shows PCB in the present device

FIG. 6 shows the position of Printed Circuit Board (PCB) in the device (10). The PCB is positioned in the handle which regulates power supply and provides adjustable means by correlating with a rotary switch (C). The one end of PCB is connected to the motor (1) and the other end is connected to a cord (D) for providing power supply.

In operation, when the current is provided in the DC motor (1) rotation of the motor shaft (2) is transmitted to the motor gear (7) through the connecting bracket (8). The cycle gear (6) and the first bevel gear (15) rotate concurrently with the motor gear (7). The rotation of the cycle gear (6) in turn moves the quarter pin joint (18) which is sandwiched between the bracket (8) and the vibrating plate (13), in up and down direction. As, the quarter pin (18) moves, the vibrating knobs (12) are also moves in same direction to offer hammering massage to user at the site of pain. The rotation of the first bevel gear (15) consequently rotates the second bevel gear (16) which leads to rotation of the oil rubbing plate (14). The switch (C) is provided on handle (B) to control the intensity of the massage as per the user's requirement.

The present invention can be used either as a vibrator massager or oil massager depending on the need of user in car or trucks.

Another advantage of the present invention is that it works on DC current in car or truck.

The further advantage of the present invention is to provide device which has dual means for massage through vibrator massager and oil rubbing massage.

The yet another advantage of the present invention is that it provides simple, easy to used device, without human or mechanical assistance.

While various embodiments of the present invention have been described in details, it is apparent that modification and adaptation of those embodiments will occur to those skilled in the art. It is expressly understood, however, that such modifications and adaptations are within the spirit and scope of the present invention as set forth in the following claims.

I claim:

1. A portable device for massage comprising a gear mounting plate at a distal end of a motor shaft of a direct current (DC) motor, the gear mounting plate having an upwardly positioned upper shaft and a lower shaft;

a cycle gear mounted on the upper shaft;

a first bevel gear mounted on the lower shaft, wherein a central hole of the cycle gear is surrounded by a toothed ring to rotate the first bevel gear concurrently with the cycle gear;

a motor gear mounted on the motor shaft and rotationally connected with the cycle gear to rotate concurrently with each other;

a bracket positioned after the motor gear on the motor shaft having hollow structure in a central region with space to accommodate bearing and crank pin to provide support and to reduce vibration of movement to the motor gear;

an actuator situated on a top of the bracket, wherein at least one pair of vibrating knobs of the vibrating plate positioned on an upper side of a case is movably connected to the bracket;

wherein a quarter pin joint is disposed between the bracket and the vibrating plate to offer up and down movement to the vibrating plate;

a second bevel gear positioned perpendicular to a lower side of the first bevel gear to rotate concurrently with the first bevel gear, and a lower surface of the second bevel gear is attached to an oil rubbing plate positioned on a lower side of the case;

the DC motor connected to a printed circuit board (PCB) placed in a handle of the device; the PCB connected to a rotary switch to adjust an intensity of a massage through a power supply.

2. The device according to claim 1, wherein the upper shaft and the lower shaft are parallel with each other.

3. The device according to claim 1, wherein the lower shaft is longer compared to the upper shaft.

4. The device according to claim 1, wherein the at least one pair of vibrating knobs are at least two hemispherical protuberances and oscillate in a pendulum movement to provide hammering massage to a body.

5. The device according to claim 1, wherein the oil rubbing plate is circular and has a protuberance detachably entrenched over the DC motor with the second bevel gear.

* * * * *